US012509280B2

(12) United States Patent
Zhang

(10) Patent No.: US 12,509,280 B2
(45) Date of Patent: Dec. 30, 2025

(54) FOLDABLE BICYCLE TRANSPORT BOX

(71) Applicant: Jie Zhang, Berwick (AU)

(72) Inventor: Jie Zhang, Berwick (AU)

( * ) Notice: Subject to any disclaimer, the term of this patent is extended or adjusted under 35 U.S.C. 154(b) by 4 days.

(21) Appl. No.: 18/660,234

(22) Filed: May 10, 2024

(65) Prior Publication Data

US 2025/0229947 A1 Jul. 17, 2025

(30) Foreign Application Priority Data

Jan. 15, 2024 (CN) ..... 202420096814.9

(51) Int. Cl.
*B65D 21/08* (2006.01)
*B65D 25/14* (2006.01)

(52) U.S. Cl.
CPC ..... *B65D 21/086* (2013.01); *B65D 25/14* (2013.01)

(58) Field of Classification Search
CPC ..... B65D 2585/6862; B65D 1/225; B65D 2313/02; B65D 25/14
See application file for complete search history.

(56) References Cited

U.S. PATENT DOCUMENTS

2021/0130082 A1* 5/2021 Ku ..... B65D 81/113
2021/0269230 A1* 9/2021 Rogers ..... B65D 51/248
2021/0339940 A1* 11/2021 Gashi ..... B65D 85/68
2022/0055793 A1* 2/2022 Shih ..... B65D 5/425
2022/0257041 A1* 8/2022 Redford ..... A47G 29/141
2023/0371667 A1* 11/2023 Lim ..... B62H 3/10
2024/0017880 A1* 1/2024 Asensio Cotillas ..... B65D 21/0226

FOREIGN PATENT DOCUMENTS

CN 204674998 U 9/2015
CN 220054881 U 11/2023

* cited by examiner

*Primary Examiner* — Shawn M Braden

(57) ABSTRACT

A foldable bicycle transport box includes a foldable box body, an upper cover and a base. A bottom of the box body is connected to the base, and an upper part is connected to the upper cover. The box body is provided with a via hole, a first connecting member is fixedly provided on an inner side surface of the box body at an edge of the via hole, a second connecting member is provided on an outer side surface of the upper cover or the base, one end of the second connecting member is fixed to the upper cover or the base, the other end is movable relative to the upper cover or the base, and an end, away from the upper cover or the base, of the second connecting member movably passes through the via hole and is detachably and fixedly connected to the first connecting member.

8 Claims, 4 Drawing Sheets

FOLDABLE BICYCLE TRANSPORT BOX

CROSS REFERENCE TO RELATED APPLICATIONS

The present application claims the benefit of Chinese Patent Application No. 202420096814.9 filed on Jan. 15, 2024, the contents of which are incorporated herein by reference in their entirety.

TECHNICAL FIELD

The present disclosure belongs to the field of transport boxes, and particularly relates to a foldable bicycle transport box.

BACKGROUND ART

Currently, for cyclists or manufacturers, folding bicycles usually need to be loaded in a specific box during carrying or transportation in order to prevent the bicycle from being scratched or running into other people.

Based on this, a bicycle transport box is provided in the prior art. For example, an existing patent application with the application number CN202321394938.7 discloses a packaging box for transportation, specifically a packaging box for transportation of an electric bicycle frame. The packaging box includes a packaging assembly. The packaging assembly includes a first housing assembly, a second housing assembly, and a strap assembly. The first housing assembly is in snap-fit with the second housing assembly. The strap assembly is tied around the first housing assembly and the second housing assembly. The strap assembly includes a strap, a first end, a second end, and a plug. The first end and the second end are integrally formed at two ends of the strap, respectively. An outer wall of one side of the first end is provided with holes distributed at equal intervals, a plurality of plugs are integrally formed on an outer wall of one side of the second end, and the plugs are plugged into the holes. Although the packaging box disclosed in the patent enables the loading of bicycles, the box body cannot be folded, and the box body is fixed by straps, which has the problems of relatively high cost and inconvenient disassembly.

Another example is a folding box with the application number CN201520090774.8. The folding box includes a cover, a box body and a base. The box body is detachable and foldable. When the folding box is used, the box body can be opened, upper and lower edges of the box body are fixed by fixing strips, and the box body is inserted in the base and then closed by the cover to form a complete toolbox. If the folding box is not used, the box body can be detached and folded into the base. The box body disclosed in this patent is foldable and convenient to carry, however, in actual transportation, straps are still required to assist in fixing the box body, the cover and the base, which causes the problems of relatively high cost and inconvenient disassembly.

SUMMARY

In order to solve the above problems, a primary object of the present disclosure is to provide a foldable bicycle transport box which is easy to assemble and disassemble.

Another object of the present disclosure is to provide a foldable bicycle transport box which is low in cost and easy to promote.

In order to achieve the above objects, the technical solutions of the present disclosure are as follows. Provided is a foldable bicycle transport box. The foldable bicycle transport box includes a foldable box body, an upper cover and a base. A bottom of the box body is connected to the base, and an upper part of the box body is connected to the upper cover. The box body is provided with a via hole, a first connecting member is fixedly provided on an inner side surface of the box body at an edge of the via hole, a second connecting member is provided on an outer side surface of the upper cover or the base, one end of the second connecting member is fixed to the upper cover or the base, the other end of the second connecting member is movable relative to the upper cover or the base, and an end, away from the upper cover or the base, of the second connecting member movably passes through the via hole and is detachably and fixedly connected to the first connecting member.

When the bicycle transport box of the present application is assembled, the first connecting member can be inserted into the box body through the via hole from the outer side surface of the upper cover or the base and is fixedly connected to the second connecting member to fix the box body to the upper cover and the base; and when the bicycle transport box is disassembled, the second connecting member can be disassembled from the first connecting member through the via hole to separate the box body from the upper cover and the base. In this way, the advantages of convenient disassembly and assembly are achieved, and there is no need to use a strap to assist in fixation, saving the cost of the transport box.

Furthermore, a plurality of the first connecting members are provided and are arranged around the inner side surface of the box body, and a plurality of the second connecting members are provided and are arranged around the outer side surface of the upper cover and the outer side surface of the base.

Furthermore, the first connecting member and the second connecting member are adhesive members mating with each other.

Preferably, each of the first connecting member and the second connecting member adopts one of a loop side and a hook side of a hook and loop fastener, and are combined to form a complete hook and loop fastener. In this application, the loop side or the hook side of the hook and loop fastener is fixed on the inner side surface of the box body, and the hook side or the loop side of the hook and loop fastener is fixed on the outer side surface of the upper cover or the base. Therefore, when the bicycle transport box is assembled or disassembled, the user only needs to reach into the via hole, and attach or unattach the hook side and the loop side of the hook and loop fastener, so that the assembly and disassembly between the box body and the upper cover and the base can be achieved in a convenient and low-cost way.

Furthermore, the box body includes a first assembly plate, an inner liner plate and a second assembly plate which are separated from each other, the first assembly plate and the second assembly plate both have a foldable n-shaped structure, and openings of the n-shapes of the first assembly plate and the second assembly plate are arranged facing each other; the inner liner plate is provided on an inner side surface of the first assembly plate and an inner side surface of the second assembly plate, and one end of the inner liner plate is adhered to the inner side surface of the first assembly plate, and the other end of the inner liner plate is adhered to the inner side surface of the second assembly plate. In this application, the first assembly plate, the inner liner plate, and the second assembly plate, which are separated from each other, are combined to form the box body, so that the disassembly of the box body is facilitated; and the first assembly plate and the second assembly plate can be easily folded at the right angles of the n-shaped structure.

Furthermore, the inner liner plate includes a first liner plate and a second liner plate capable of being folded up, one end of the first liner plate and one end of the second liner plate are connected, the first liner plate is adhered to the inner side surface of the first assembly plate, and the second liner plate is adhered to the inner side surface of the second assembly plate.

Furthermore, two or more inner liner plates are provided, with one or more of the inner liner plates being adhered to a front side of the first assembly plate and a front side of the second assembly plate, and one or more of the inner liner plates being adhered to a rear side of the first assembly plate and a rear side of the second assembly plate.

Furthermore, the first connecting member is fixed on an inner side surface of the inner liner plate, the first assembly plate, the inner liner plate, and the second assembly plate are all provided with the via holes, and the via holes in the first assembly plate and the second assembly plate are corresponding to the via holes in the inner liner plate in position. In this application, when the second connecting member is connected to the first connecting member through the via hole, not only the fixation between the box body and the upper cover and the base can be achieved, but also the fixation between the first assembly plate, the second assembly plate and the inner liner plate of the box body can be achieved.

Furthermore, each of the upper cover and the base has a square groove-shaped structure with one end opened, and includes a first folding part and a second folding part capable of being folded up, one end of the first folding part and one end of the second folding part are connected, and folding grooves are provided at the ends, away from each other, of the first folding part and the second folding part. The upper cover and the base can be folded into a flat plate, facilitating the storing and carrying of the upper cover and the base.

Compared with the prior art, the foldable bicycle transport box of the present application has the following beneficial effects. The first connecting member is provided on the upper cover and the base, and the via hole and the second connecting member are provided on the box body. When the bicycle transport box of the present application is assembled, the first connecting member can be inserted into the box body through the via hole from the outer side surface of the upper cover or the base and is fixedly connected to the second connecting member to fix the box body to the upper cover and the base; when the bicycle transport box is disassembled, the second connecting member can be disassembled from the first connecting member through the via hole to separate the box body from the upper cover and the base. In this way, the advantages of convenient disassembly and assembly are achieved, and there is no need to use a strap to assist in fixation, saving the cost of the transport box.

DETAILED DESCRIPTION

In order to make the objects, technical solutions and advantages of the present disclosure clearer, the present disclosure is described in further detail below with reference to the drawings and embodiments. It should be understood that the specific embodiments described herein are merely illustrative of the present disclosure and are not intended to limit the present disclosure.

Figure 1:
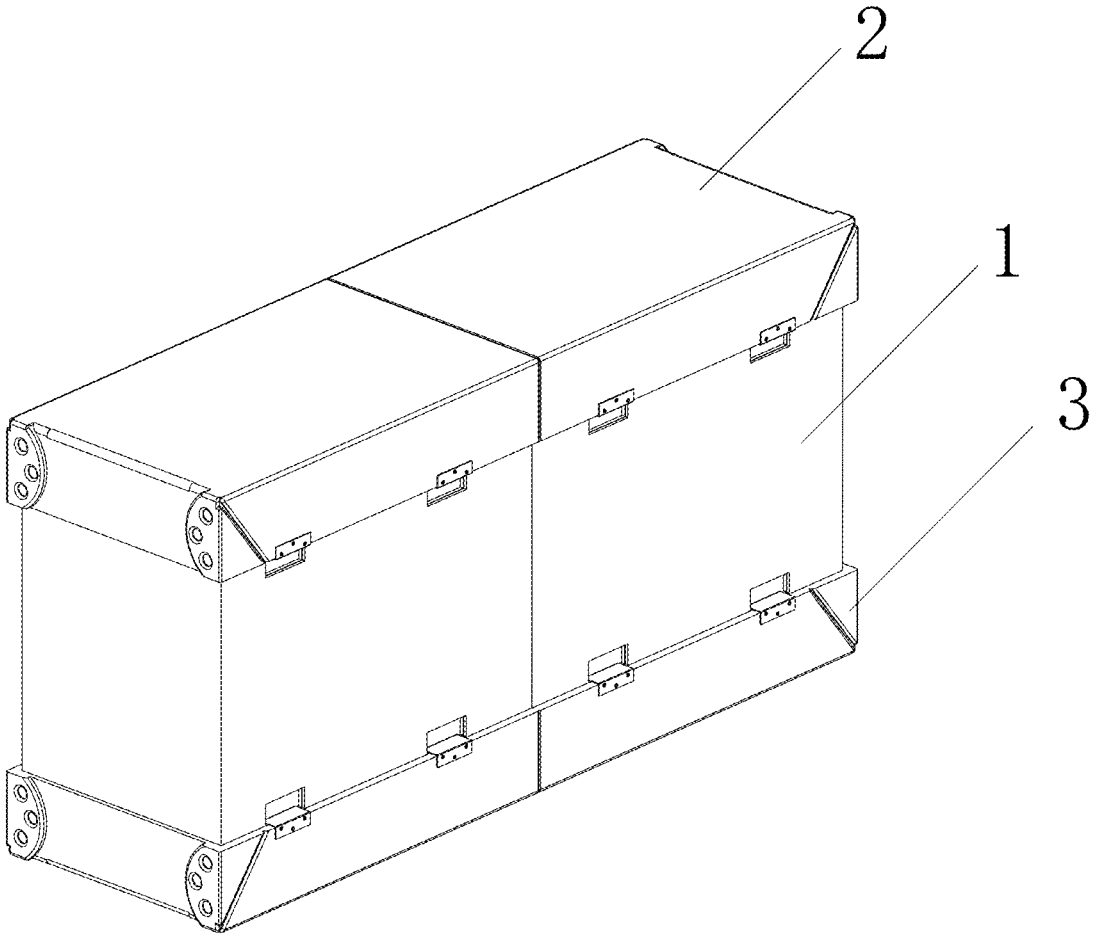
FIG. 1 is a schematic diagram of a bicycle transport box.
Figure 2:
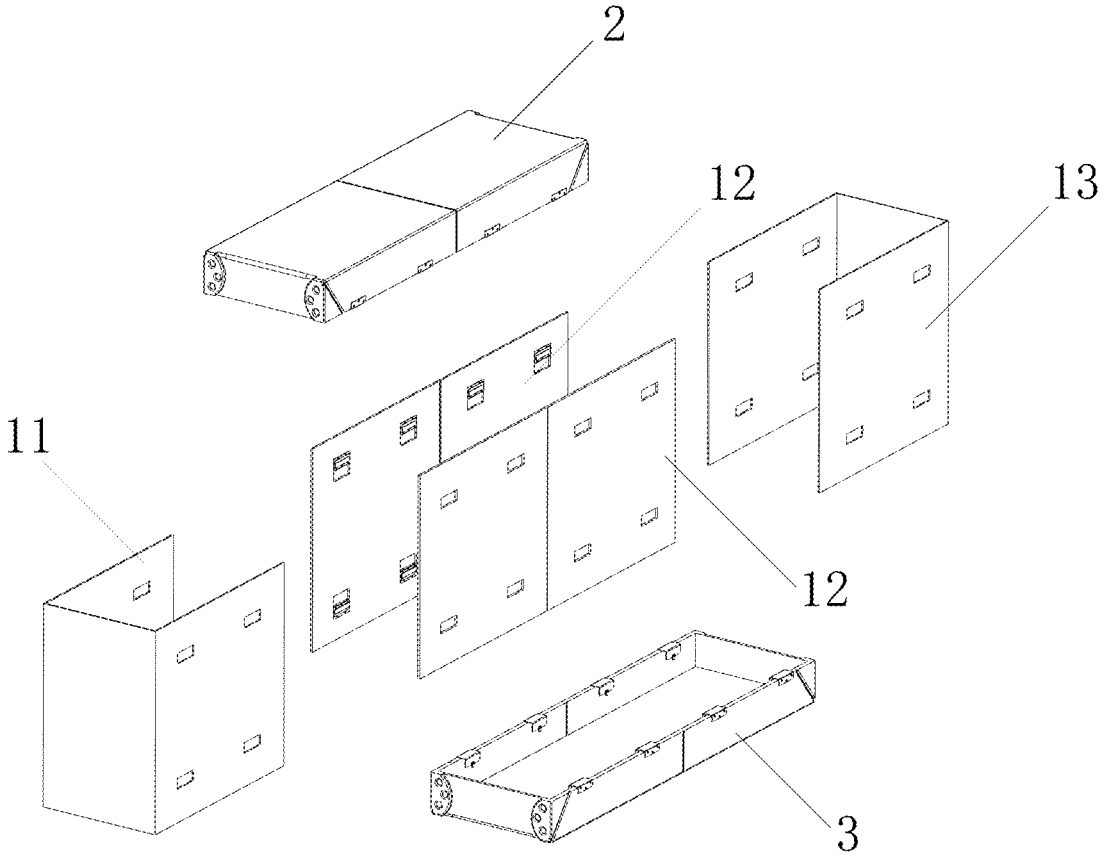
FIG. 2 is an exploded view of the bicycle transport box.
Figure 3:
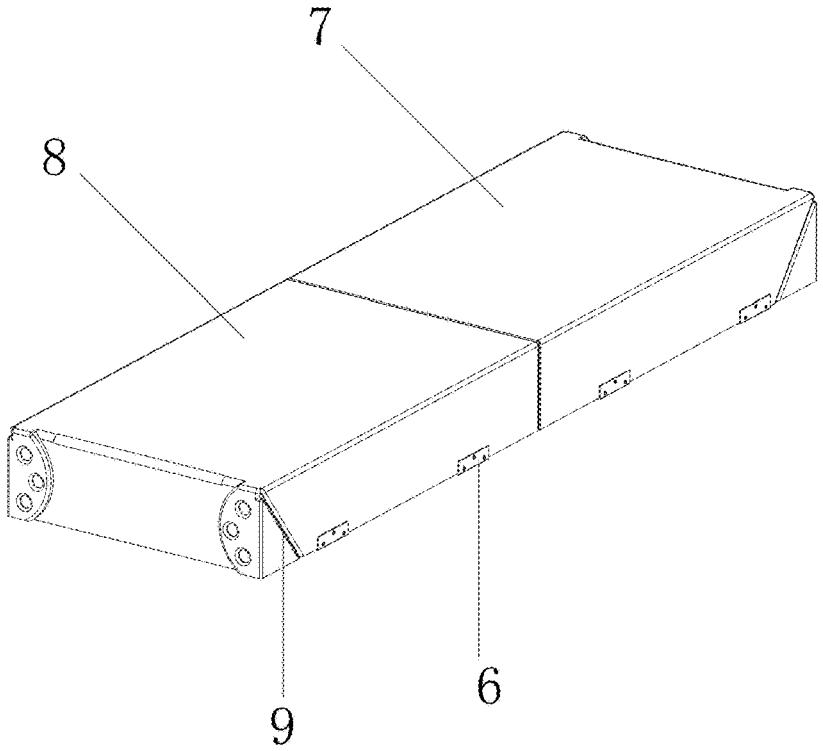
FIG. 3 is a schematic diagram of an upper cover.
Figure 4:
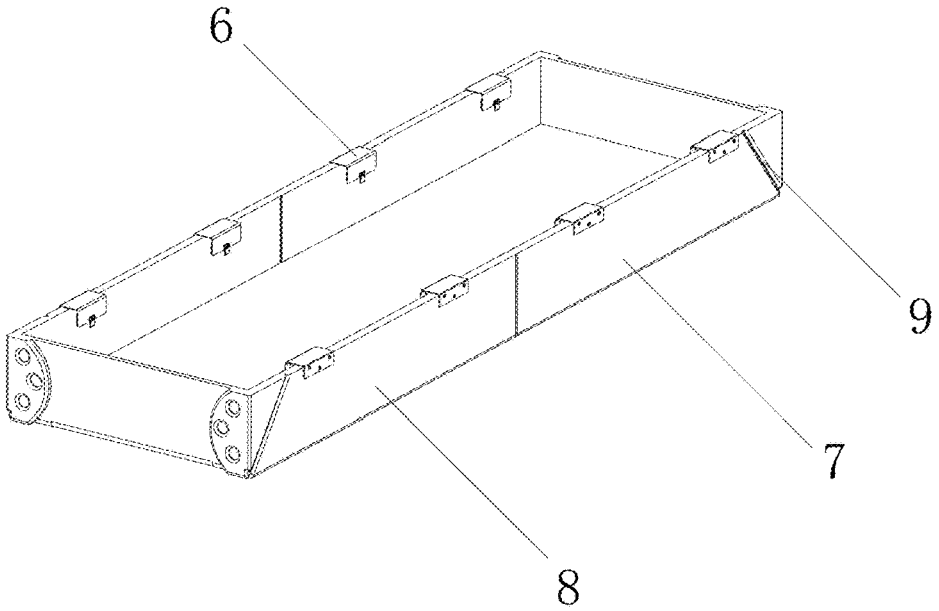
FIG. 4 is a schematic diagram of a base.
Figure 5:
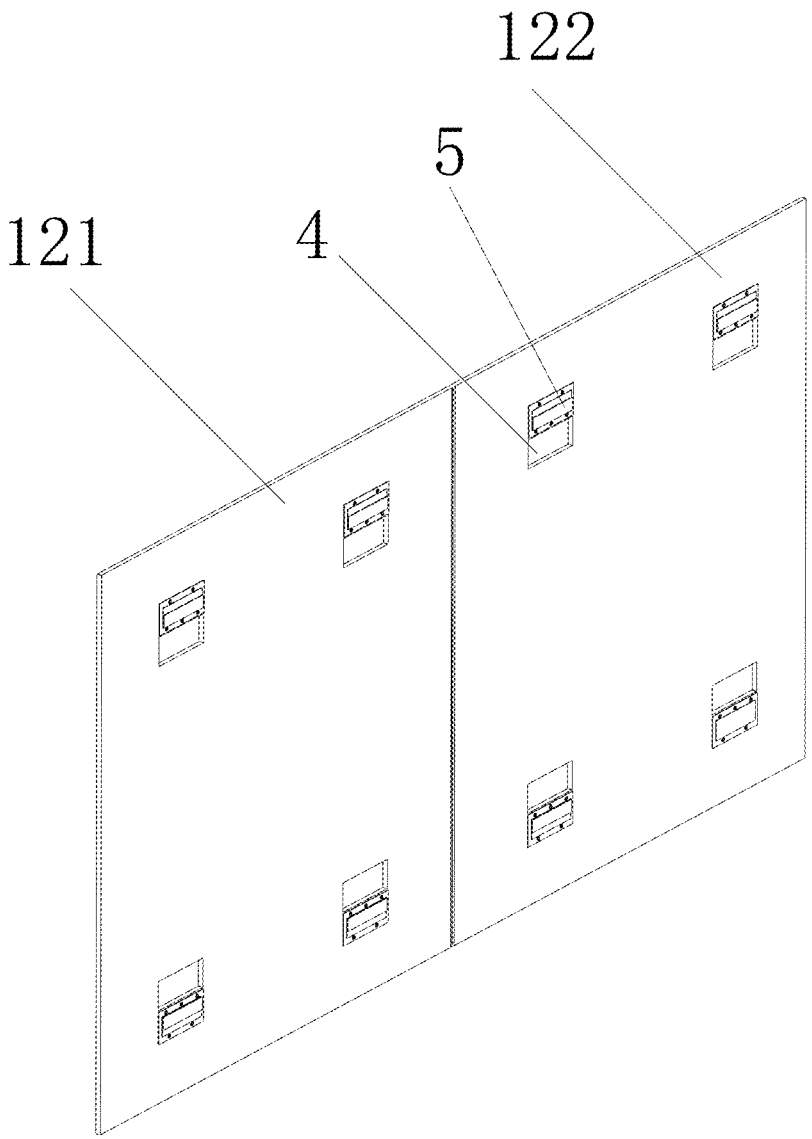
FIG. 5 is a schematic diagram of an inner liner plate.

In order to achieve the above objects, the technical solutions of the present disclosure are as follows. Referring to FIGS. 1 to 5, provided is a foldable bicycle transport box. The foldable bicycle transport box includes a foldable box body 1, an upper cover 2 and a base 3. A bottom of the box body 1 is connected to the base 3, and an upper part of the box body 1 is connected to the upper cover 2. The box body 1 is provided with a via hole 4, a first connecting member 5 is provided on an inner side surface of the box body 1 at an edge of the via hole 4, a second connecting member 6 is provided on an outer side surface of the upper cover 2 or the base 3, one end of the second connecting member 6 is fixed to the upper cover 2 or the base 3, the other end of the second connecting member is movable relative to the upper cover 2 or the base 3, and an end, away from the upper cover 2 or the base 3, of the second connecting member 6 movably passes through the via hole 4 and is detachably and fixedly connected to the first connecting member 5. When the bicycle transport box of the present application is assembled, the first connecting member 5 can be inserted into the box body 1 through the via hole 4 from the outer side surface of the upper cover 2 or the base 3 and is fixedly connected to the second connecting member 6 to fix the box body 1 to the upper cover 2 and the base 3; and when the bicycle transport box is disassembled, the second connecting member 6 can be disassembled from the first connecting member 5 through the via hole 4 to separate the box body 1 from the upper cover 2 and the base 3. In this way, the advantages of convenient disassembly and assembly are achieved, and there is no need to use a strap to assist in fixation, saving the cost of the transport box.

Furthermore, a plurality of the first connecting members 5 are provided and are arranged around the inner side surface of the box body 1, and a plurality of the second connecting members 6 are provided and are arranged around the outer side surface of the upper cover 2 and the outer side surface of the base 3.

Furthermore, the first connecting member 5 adopts a loop side of a hook and loop fastener, the second connecting member 6 adopts a hook side of a hook and loop fastener, and the first connecting member 5 and the second connecting member 6 are combined to form a complete hook and loop fastener. In this application, the hook side of the hook and loop fastener is fixed on the inner side surface of the box body 1, and the loop side of the hook and loop fastener is fixed on the outer side surfaces of the upper cover 2 and the base 3. Therefore, when the bicycle transport box is assembled or disassembled, the user only needs to reach into the via hole 4, and attach or unattach the hook side and the loop side of the hook and loop fastener, so that the assembly and disassembly between the box body 1 and the upper cover 2 and the base 3 can be achieved in a convenient and low-cost way.

Furthermore, the box body 1 includes a first assembly plate 11, an inner liner plate 12 and a second assembly plate 13 which are separated from each other, the first assembly plate 11 and the second assembly plate 13 both have a foldable n-shaped structure, and openings of the n-shapes of the first assembly plate 11 and the second assembly plate are arranged facing each other; the inner liner plate 12 is provided on an inner side surface of the first assembly plate 11 and an inner side surface of the second assembly plate 13, and one end of the inner liner plate 12 is adhered to the inner side surface of the first assembly plate, and the other end of the inner liner plate is adhered to the inner side surface of the second assembly plate 13. In this application, the first assembly plate 11, the inner liner plate 12, and the second assembly plate 13, which are separated from each other, are combined to form the box body 1, so that the disassembly of the box body 1 is facilitated; and the first assembly plate 11 and the second assembly plate 13 can be easily folded at the right angles of the n-shaped structure.

Furthermore, the inner liner plate 12 includes a first liner plate 121 and a second liner plate 122 capable of being folded up, one end of the first liner plate 121 and one end of the second liner plate 122 are connected, the first liner plate 121 is adhered to the inner side surface of the first assembly plate 11, and the second liner plate 122 is adhered to the inner side surface of the second assembly plate 13.

Furthermore, two inner liner plates 12 are provided, one inner liner plate 12 is adhered to a front side of the first assembly plate 11 and a front side of the second assembly plate 13, and one inner liner plate 12 is adhered to a rear side of the first assembly plate 11 and a rear side of the second assembly plate 13.

Furthermore, the first connecting member 5 is fixed on the inner side surface of the inner liner plate 12, the first assembly plate 11, the inner liner plate 12, and the second assembly plate 13 are all provided with the via holes 4, and the via holes 4 in the first assembly plate 11 and the second assembly plate 13 are corresponding to the via holes 4 in the inner liner plate 12 in position. In this application, when the second connecting member 6 is connected to the first connecting member 5 through the via hole 4, not only the fixation between the box body 1 and the upper cover 2 and the base 3 can be achieved, but also the fixation between the first assembly plate 11, the second assembly plate 13 and the inner liner plate 12 of the box body 1 can be achieved.

Furthermore, each of the upper cover 2 and the base 3 has a square groove-shaped structure with one end opened, and includes a first folding part 7 and a second folding part 8 capable of being folded up, one end of the first folding part 7 and one end of the second folding part 8 are connected, and folding grooves 9 are provided at the ends, away from each other, of the first folding part 7 and the second folding part 8. The upper cover 2 and the base 3 can be folded into a flat plate, facilitating the storage and carrying of the upper cover 2 and the base 3.

The above is merely a preferred embodiment of the present disclosure and is not intended to limit the present disclosure. Any modifications, equivalents, and improvements made within the spirit and principles of the present disclosure are intended to be included within the scope of the present disclosure.

What is claimed is:

1. A foldable bicycle transport box, comprising a foldable box body, an upper cover and a base, wherein a bottom of the box body is connected to the base, and an upper part of the box body is connected to the upper cover; the box body is provided with a via hole, a first connecting member is fixedly provided on an inner side surface of the box body at an edge of the via hole, a second connecting member is provided on an outer side surface of the upper cover or the base, one end of the second connecting member is fixed to the upper cover or the base, the other end of the second connecting member is movable relative to the upper cover or the base, and an end, away from the upper cover or the base, of the second connecting member movably passes through the via hole and is detachably and fixedly connected to the first connecting member;

wherein the box body comprises a first assembly plate, an inner liner plate and a second assembly plate which are separated from each other, the first assembly plate and the second assembly plate both have a foldable n-shaped structure, and openings of the n-shapes of the first assembly plate and the second assembly plate are arranged facing each other; the inner liner plate is provided on an inner side surface of the first assembly plate and an inner side surface of the second assembly plate, and one end of the inner liner plate is adhered to the inner side surface of the first assembly plate, and the other end of the inner liner plate is adhered to the inner side surface of the second assembly plate.

2. The foldable bicycle transport box according to claim 1, wherein a plurality of the first connecting members are provided and are arranged around the inner side surface of the box body, and a plurality of the second connecting members are provided and are arranged around the outer side surface of the upper cover and the outer side surface of the base.

3. The foldable bicycle transport box according to claim 1, wherein the first connecting member and the second connecting member are adhesive members mating with each other.

4. The foldable bicycle transport box according to claim 3, wherein each of the first connecting member and the second connecting member adopts one of a loop side and a hook side of a hook and loop fastener, and the first connecting member and the second connecting member are combined to form a complete hook and loop fastener.

5. The foldable bicycle transport box according to claim 1, wherein the inner liner plate comprises a first liner plate and a second liner plate capable of being folded up, one end of the first liner plate and one end of the second liner plate are connected, the first liner plate is adhered to the inner side surface of the first assembly plate, and the second liner plate is adhered to the inner side surface of the second assembly plate.

6. The foldable bicycle transport box according to claim 1, wherein two or more inner liner plates are provided, with one or more of the inner liner plates being adhered to a front side of the first assembly plate and a front side of the second assembly plate, and one or more of the inner liner plates being adhered to a rear side of the first assembly plate and a rear side of the second assembly plate.

7. The foldable bicycle transport box according to claim 1, wherein the first connecting member is fixed on an inner side surface of the inner liner plate, the first assembly plate, the inner liner plate, and the second assembly plate are all provided with the via holes, and the via holes in the first assembly plate and the second assembly plate are corresponding to the via holes in the inner liner plate in position.

8. The foldable bicycle transport box according to claim 1, wherein each of the upper cover and the base has a square groove-shaped structure with one end opened, and comprises a first folding part and a second folding part capable of being folded up, one end of the first folding part and one end of the second folding part are connected, and folding grooves are provided at the ends, away from each other, of the first folding part and the second folding part.

* * * * *